US007922508B2

(12) United States Patent
Kondas

(10) Patent No.: US 7,922,508 B2
(45) Date of Patent: Apr. 12, 2011

(54) ELECTRICAL DISTRIBUTION SYSTEM WITH A JUMPER ASSEMBLY HAVING A TELESCOPIC SLIDER

(75) Inventor: Shawn J. Kondas, Kendallville, IN (US)

(73) Assignee: Group Dekko, Inc., Kendallville, IN (US)

( * ) Notice: Subject to any disclaimer, the term of this patent is extended or adjusted under 35 U.S.C. 154(b) by 0 days.

(21) Appl. No.: 12/638,062

(22) Filed: Dec. 15, 2009

(65) Prior Publication Data

US 2010/0151724 A1 Jun. 17, 2010

Related U.S. Application Data

(60) Provisional application No. 61/122,492, filed on Dec. 15, 2008, provisional application No. 61/139,859, filed on Dec. 22, 2008.

(51) Int. Cl.
*H01R 25/00* (2006.01)

(52) U.S. Cl. ..... 439/211; 439/215

(58) Field of Classification Search ..... 439/211, 439/215, 207, 210, 214, 505; 174/494, 497
See application file for complete search history.

(56) References Cited

U.S. PATENT DOCUMENTS

| | | | | |
|---|---|---|---|---|
| 2,280,728 | A | | 4/1942 | Streib |
| 3,715,629 | A | | 2/1973 | Swengel, Sr. |
| 3,768,068 | A | | 10/1973 | Palecek |
| 3,792,189 | A | | 2/1974 | Stengel et al. |
| 4,013,329 | A | | 3/1977 | Hugin |
| 4,135,775 | A | | 1/1979 | Driscoll |
| 4,214,799 | A | | 7/1980 | Biche |
| 4,270,020 | A | * | 5/1981 | Kenworthy et al. ..... 174/497 |
| 4,278,834 | A | * | 7/1981 | Boundy ..... 174/497 |
| 4,367,370 | A | | 1/1983 | Wilson et al. |
| 4,492,419 | A | | 1/1985 | Denckert |
| 4,538,869 | A | | 9/1985 | Richards |
| 4,579,403 | A | | 4/1986 | Byrne |
| 4,688,869 | A | | 8/1987 | Kelly |
| 4,740,167 | A | | 4/1988 | Millhimes et al. |
| 4,740,180 | A | | 4/1988 | Harwath et al. |
| 4,918,886 | A | * | 4/1990 | Benoit et al. ..... 174/497 |
| 4,959,021 | A | | 9/1990 | Byrne |
| 4,990,110 | A | | 2/1991 | Byrne |
| 5,013,252 | A | * | 5/1991 | Nienhuis et al. ..... 439/215 |
| 5,032,086 | A | | 7/1991 | Skowronski et al. |
| 5,041,002 | A | | 8/1991 | Byrne |
| 5,087,207 | A | | 2/1992 | Byrne |
| 5,096,431 | A | | 3/1992 | Byrne |
| 5,096,433 | A | | 3/1992 | Boundy |
| 5,096,434 | A | | 3/1992 | Byrne |
| 5,104,332 | A | | 4/1992 | McCoy |

(Continued)

FOREIGN PATENT DOCUMENTS

FR 2 793 080 A1 11/2000

(Continued)

*Primary Examiner* — Chandrika Prasad
(74) *Attorney, Agent, or Firm* — Taylor IP

(57) ABSTRACT

An electrical distribution system for electrifying a plurality of wall panels includes a jumper assembly including a telescoping slider which includes a plurality of conductors housed therein which slide relative to one another, the jumper assembly being configured for connecting to a first electrical distribution device connected to a first wall panel of the plurality of wall panels and for connecting to a second electrical distribution device connected to a second wall panel of the plurality of wall panels.

18 Claims, 5 Drawing Sheets

U.S. PATENT DOCUMENTS

| | | | | |
|---|---|---|---|---|
| 5,149,017 | A | 9/1992 | McEntire et al. | |
| 5,171,159 | A | 12/1992 | Byrne | |
| 5,186,640 | A * | 2/1993 | McCoy | 439/211 |
| 5,203,711 | A | 4/1993 | Bogiel | |
| 5,318,454 | A | 6/1994 | Deer et al. | |
| 5,336,097 | A * | 8/1994 | Williamson et al. | 439/94 |
| 5,396,027 | A * | 3/1995 | Zemen, Jr. | 174/494 |
| 5,441,416 | A | 8/1995 | Gajewski et al. | |
| 5,488,392 | A | 1/1996 | Harris | |
| 5,562,469 | A | 10/1996 | Nienhuis et al. | |
| 5,645,459 | A | 7/1997 | Fitting | |
| 5,861,606 | A | 1/1999 | Castle et al. | |
| 5,938,479 | A | 8/1999 | Paulson et al. | |
| 5,941,720 | A | 8/1999 | Byrne | |
| 6,027,352 | A | 2/2000 | Byrne | |
| 6,036,516 | A | 3/2000 | Byrne | |
| 6,036,517 | A | 3/2000 | Byrne | |
| 6,086,388 | A | 7/2000 | Sloey et al. | |
| 6,185,812 | B1 | 2/2001 | Castle et al. | |
| 6,406,314 | B1 | 6/2002 | Byrne | |
| 6,575,777 | B2 * | 6/2003 | Henriott et al. | 439/215 |
| 6,854,989 | B2 | 2/2005 | Milan | |
| 7,008,248 | B2 * | 3/2006 | Kondas et al. | 439/211 |
| 7,034,221 | B2 | 4/2006 | Johnston et al. | |
| D519,941 | S | 5/2006 | Kondas | |
| 7,049,531 | B2 | 5/2006 | Kondas et al. | |
| 7,114,972 | B1 * | 10/2006 | Riner | 439/215 |
| 7,201,589 | B2 | 4/2007 | Jong | |
| 7,201,593 | B2 * | 4/2007 | Kondas et al. | 439/215 |
| 7,238,056 | B2 | 7/2007 | McCoy | |
| 7,271,357 | B2 | 9/2007 | Ostmeier | |
| D560,168 | S | 1/2008 | McCoy | |
| D560,610 | S | 1/2008 | McCoy | |
| 7,341,480 | B2 | 3/2008 | Byrne | |
| 7,356,924 | B2 | 4/2008 | Johnson et al. | |
| 7,410,379 | B1 | 8/2008 | Byrne | |
| 7,438,566 | B2 | 10/2008 | Chen | |
| 7,465,178 | B2 | 12/2008 | Byrne | |
| 7,494,356 | B2 | 2/2009 | Byrne | |
| 7,534,122 | B2 | 5/2009 | Byrne | |
| 7,641,510 | B2 | 1/2010 | Byrne | |
| 7,688,564 | B2 | 3/2010 | Byrne | |
| 2003/0012026 | A1 | 1/2003 | Shen | |
| 2005/0011657 | A1 | 1/2005 | Johnston et al. | |
| 2005/0111657 | A1 | 5/2005 | Lee et al. | |
| 2005/0215093 | A1 | 9/2005 | Jong | |
| 2006/0024996 | A1 | 2/2006 | Johnson et al. | |
| 2006/0035499 | A1 | 2/2006 | Johnson et al. | |
| 2008/0146054 | A1 | 6/2008 | Byrne | |
| 2008/0188106 | A1 | 8/2008 | Byrne | |
| 2008/0214034 | A1 | 9/2008 | Byrne | |
| 2008/0254661 | A1 | 10/2008 | Byrne | |
| 2008/0280470 | A1 | 11/2008 | Byrne | |
| 2008/0280475 | A1 | 11/2008 | Byrne | |
| 2009/0221169 | A1 | 9/2009 | Byrne | |
| 2009/0239402 | A1 | 9/2009 | Byrne | |
| 2009/0239403 | A1 | 9/2009 | Byrne | |
| 2009/0240370 | A1 | 9/2009 | Nichols et al. | |

FOREIGN PATENT DOCUMENTS

| | | | |
|---|---|---|---|
| WO | 2004/057716 | A1 | 7/2004 |

* cited by examiner

ELECTRICAL DISTRIBUTION SYSTEM WITH A JUMPER ASSEMBLY HAVING A TELESCOPIC SLIDER

CROSS REFERENCE TO RELATED APPLICATIONS

This is a non-provisional application based upon (a) U.S. provisional patent application Ser. No. 61/122,492, entitled "WALL PANEL ELECTRICAL DISTRIBUTION SYSTEM", filed Dec. 15, 2008, which is incorporated herein by reference, and (b) U.S. provisional patent application Ser. No. 61/139,859, entitled "WALL PANEL ELECTRICAL DISTRIBUTION SYSTEM", filed Dec. 22, 2008, which is incorporated herein by reference.

BACKGROUND OF THE INVENTION

1. Field of the Invention

The present invention relates to electrified wall panels, and, more particularly, to an electrical distribution system for electrifying wall panels.

2. Description of the Related Art

Modular office furniture typically includes a plurality of modular wall panels which are coupled together in various orientations and configurations to define work spaces in an office environment. The modular wall panels are configured to connect with accessories, such as work surfaces, overhead storage bins, etc., so that each work space or cubical may be configured as desired. Such wall panels are often electrified to provide electrical power to lighting, computers, etc. These wall panels often include a raceway so that electrical distribution devices can be positioned therein to provide electrical power to electrical receptacles, into which electrical power cords can be plugged. Further, electrical power is often transmitted from one wall panel to an adjacent wall panel via the electrical distribution devices in the raceways of the wall panels. A gap can exist between an electrical distribution device in the upstream wall panel (relative to the direction of flow of electrical power) and an electrical distribution device in the downstream wall panel. Jumpers can be used to bridge this gap. However, the length of this gap can vary depending upon the application—that is, depending upon the location of the wall panels and the electrical distribution devices within their raceways. Thus, a plurality of differently sized jumpers are maintained in stock and selected according to the length of the gap.

What is needed in the art is a jumper assembly which is adjustable in length.

SUMMARY OF THE INVENTION

The present invention provides a jumper assembly which is adjustable in length using a telescoping slider.

The invention in one form is directed to an electrical distribution system for electrifying a plurality of wall panels. The electrical distribution system includes a jumper assembly including a telescoping slider which includes a plurality of conductors housed therein which slide relative to one another, the jumper assembly being configured for connecting to a first electrical distribution device connected to a first wall panel of the plurality of wall panels and for connecting to a second electrical distribution device connected to a second wall panel of the plurality of wall panels.

The invention in another form is directed to a jumper assembly of an electrical distribution system for electrifying a plurality of wall panels. The jumper assembly includes a telescoping slider which includes a plurality of conductors housed therein which slide relative to one another, the jumper assembly being configured for connecting to a first electrical distribution device connected to a first wall panel of the plurality of wall panels and for connecting to a second electrical distribution device connected to a second wall panel of the plurality of wall panels.

The invention in yet another form is directed to a method of electrifying a plurality of wall panels, said method including the steps of: providing an electrical distribution system including a first electrical distribution device connected to a first wall panel of the plurality of wall panels, a second electrical distribution device connected to a second wall panel of the plurality of wall panels, and a jumper assembly, the jumper assembly including a telescoping slider which includes a plurality of conductors housed therein which slide relative to one another; and connecting the jumper assembly to the first electrical distribution device and to the second electrical distribution device.

An advantage of the present invention is that it provides a jumper assembly with a telescoping slider which can be lengthened or shortened according to the needs of an installer.

Another advantage is that the jumper assembly with the telescoping slider provides a way for a manufacturer of wall panel electrical devices to reduce its costs.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
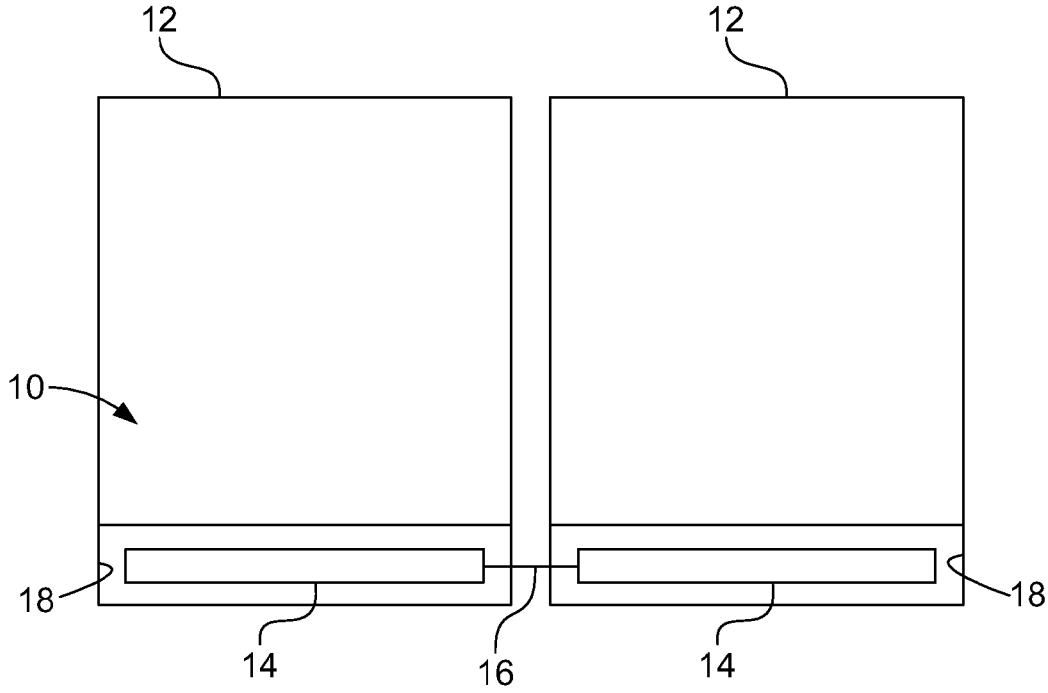
FIG. 1 is a schematic view of an embodiment of an electrical distribution system according to the present invention.

Referring now to the drawings, and more particularly to FIG. 1, there is shown an electrical distribution system 10 for electrifying a plurality of wall panels 12. Electrical distribution system 10 generally includes a first electrical distribution device 14, a second electrical distribution device 14, and a jumper assembly 16.

Each wall panel 12 of the plurality of wall panels 12 can be a modular office wall panel 12 which can be easily configured and reconfigured relative to other modular office wall panels 12 so as to define office work stations. Each wall panel 12 has at least one raceway 18, which can be located along the baseline of the respective wall panel 12, as shown in FIG. 1.

Figure 2:
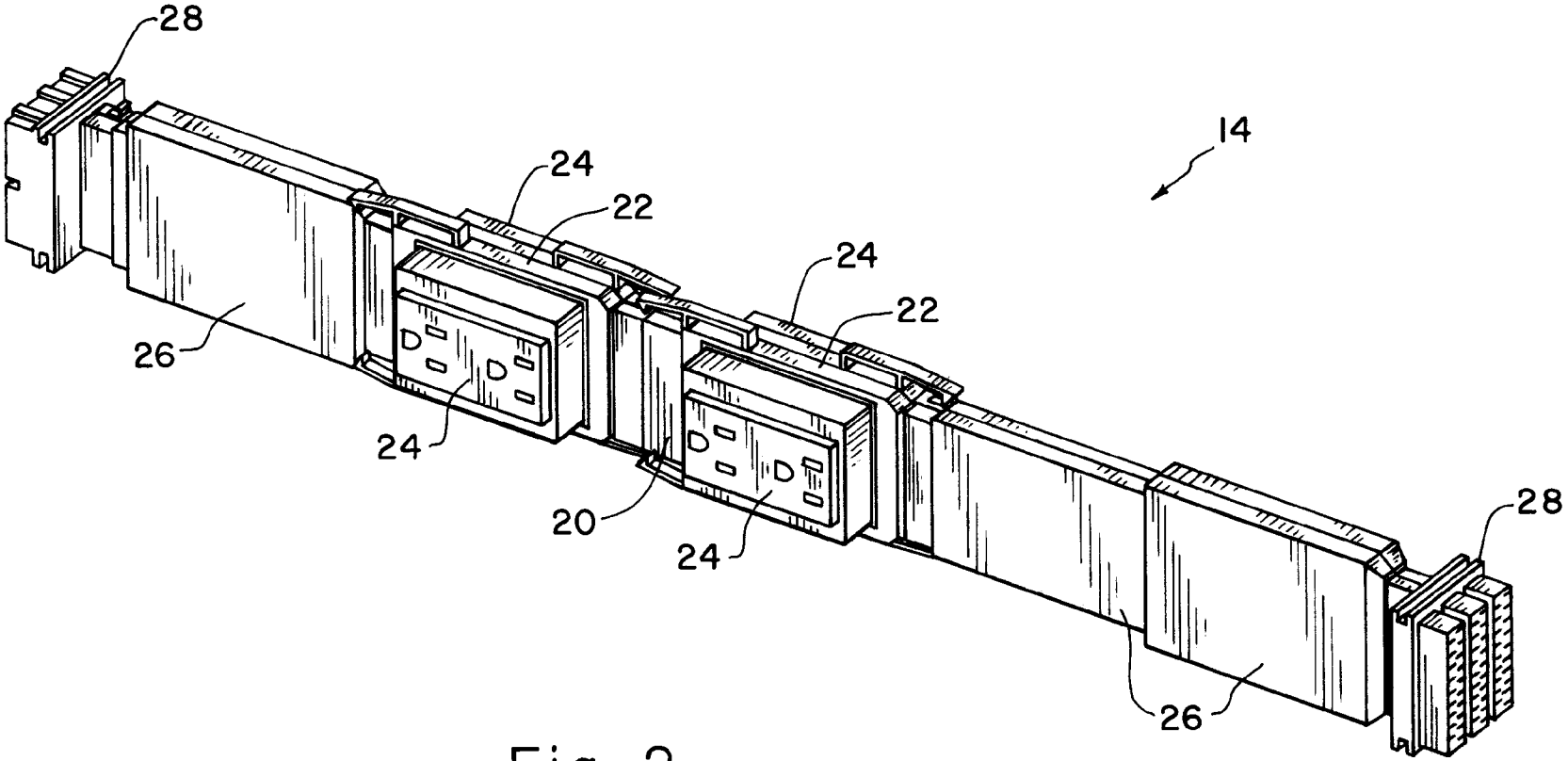
FIG. 2 is a perspective view of an exemplary electrical distribution device of the electrical distribution system according to the present invention.

First electrical distribution device 14 is connected to first wall panel 12 of the plurality of wall panels, and second electrical distribution device 14 is connected to a second wall panel 12 of the plurality of wall panels. For point of reference, first electrical distribution device 14 and first wall panel 12 can be disposed on the left-hand side of FIG. 1, while second electrical distribution device 14 and second wall panel 12 can be disposed on the right-hand side of FIG. 1. Each electrical distribution device 14 can be disposed respectively in raceways 18 of panels 12. Jumper assembly 16, as more fully explained below, is used to connect electrical distribution devices 14. Each electrical distribution device 14 can be substantially identical to one another and can otherwise be referred to as an electrical distribution harness 14. Only one electrical distribution device 14 is shown in FIG. 2. FIG. 2 shows merely one embodiment of an electrical distribution device which can be disposed in a wall panel raceway 18; it is understood that other electrical distribution devices with different pieces and configurations could serve as the electrical distribution devices which connect to jumper assembly 16. FIG. 2 shows electrical distribution device 14 as a modular electrical distribution harness which includes a center block connector 20, a plurality of receptacle pods 22, a plurality of electrical receptacles 24, a plurality of telescoping sliders 26, and a plurality of end block connectors 28 (which are electrical connectors). Each of these pieces 20, 22, 24, 26, 28 can be modular. When each piece 20, 22, 24, 26, 28 is modular for example, electrical distribution device 14 can take on a number of configurations. For instance, if more receptacles 24 are needed by an end-user, an additional center block connector 20 (which can also be referred to as a transition piece connector) could be used to connect another receptacle pod 22 to an existing receptacle pod 22.

Figure 3:
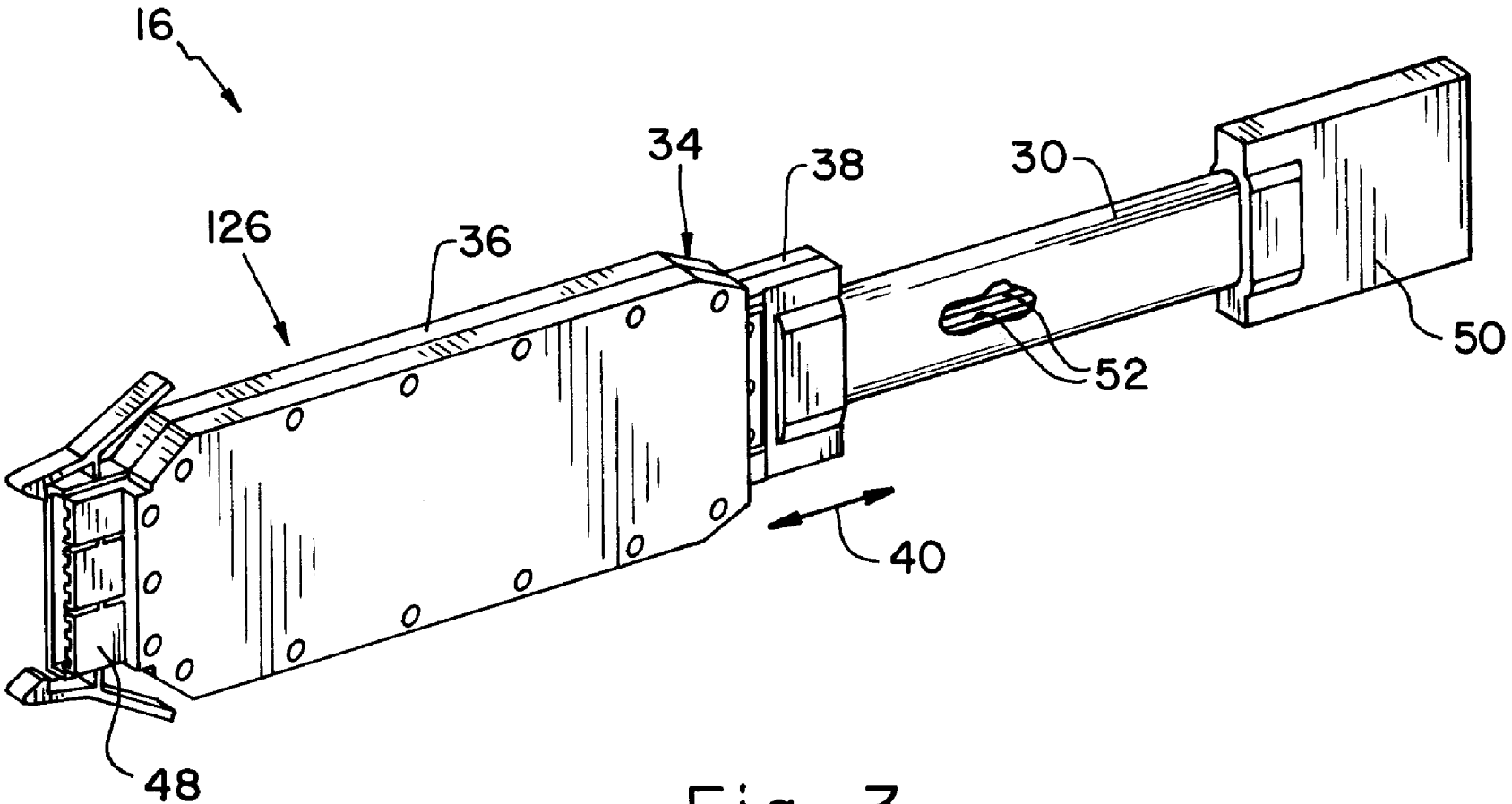
FIG. 3 is a perspective view of a jumper assembly according to the present invention, the jumper assembly being in the retracted position.
Figure 4:
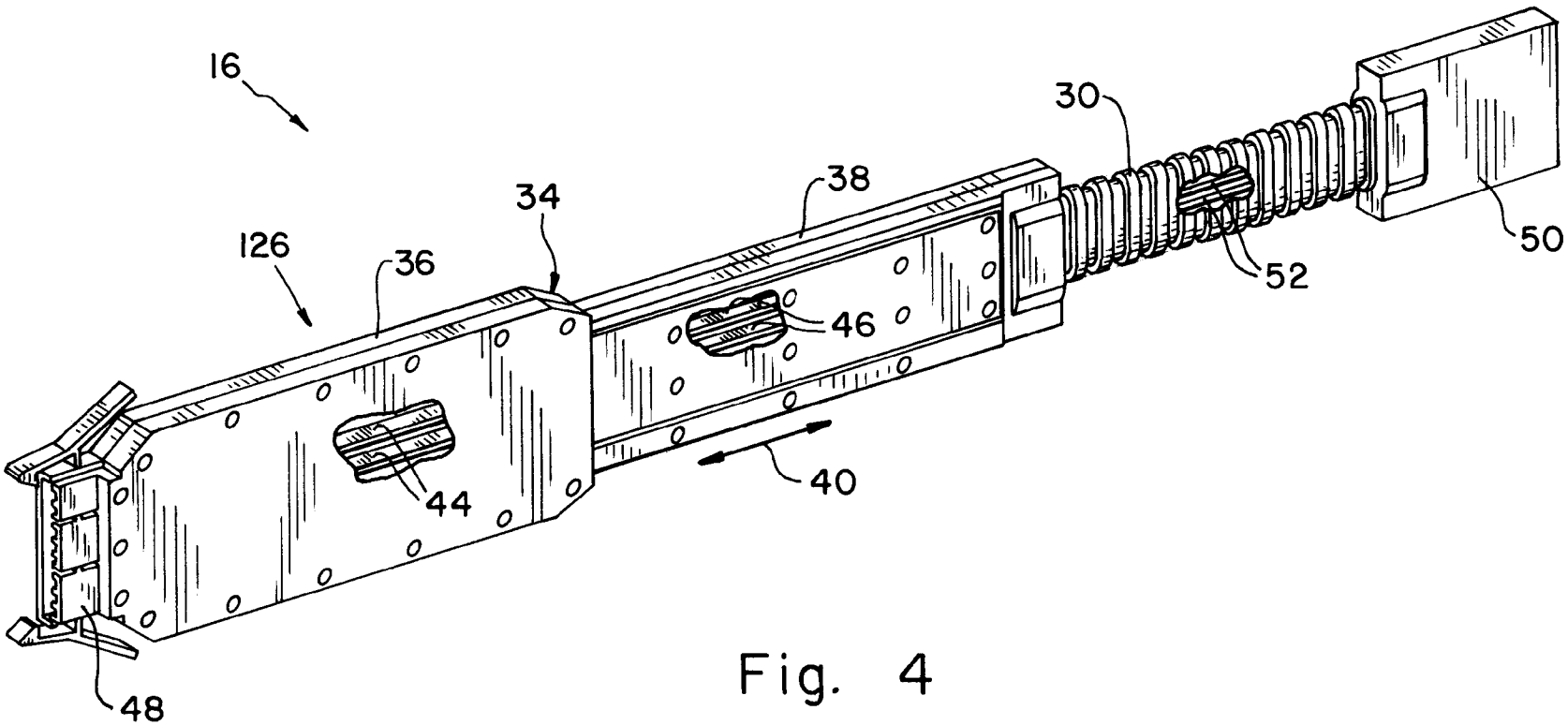
FIG. 4 is a perspective view of a jumper assembly of FIG. 3 but including a flexible conduit rather than a mesh sleeve, the jumper assembly being in the extended position.

FIGS. 3 and 4 show jumper assembly 16 according to the present invention. Jumper assembly 16 is configured for connecting to first electrical distribution device 14 and for connecting to second electrical distribution device 14. Jumper assembly 16, as shown in FIG. 1, simultaneously connects first and second electrical distribution devices 14 together. Jumper assembly 16 includes a telescoping slider 126, a mesh sleeve 30 (FIG. 3) or a flexible conduit 30 (FIG. 4), and an end connector 32. Slider 26 and 126 are similar to one another and are different embodiments of the telescoping slider of the present invention. It is understood that slider 26 could be modified as needed to substitute for slider 126 in jumper assembly 16.

Figure 6:
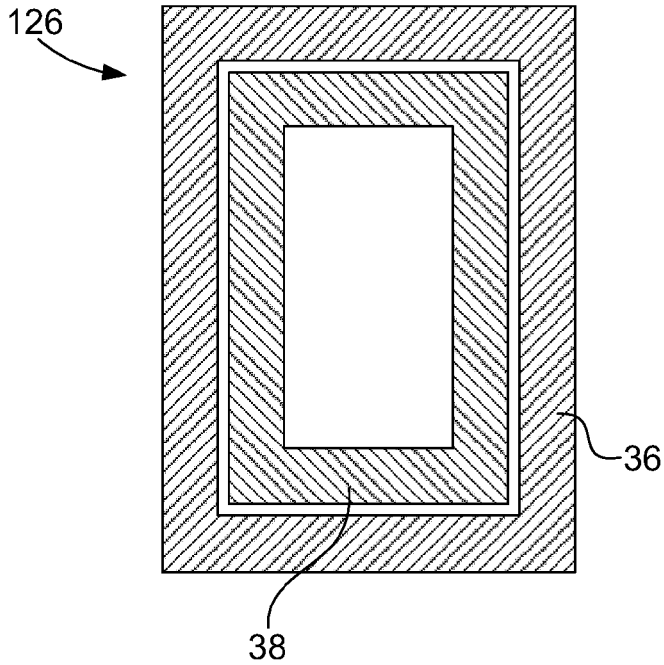
FIG. 6 is a schematic, sectional view of the jumper assembly of FIG. 4.

Telescoping slider 126 includes a housing 34 including an outside housing 36 and an inside housing 38 which are configured for moving between a retracted position and an extended position relative to one another and thereby for adjusting a length of jumper assembly 16 depending upon a distance between first and second electrical distribution devices 14. FIG. 3 shows slider 126 in the retracted position, and FIG. 4 shows slider 126 in the extended position. Thus, slider 126 can be extended, as needed, by an installer of electrical distribution system 10; in other words, slider 126 can be selectively lengthened or shortened. The double-arrow 40 in FIGS. 3 and 4 show the direction in which inside housing 38 can move relative to outside housing 36 to occupy the retracted and extended positions. That outside housing 36 surrounds inside housing 38 and that inside housing 38 can move between extended and retracted positions relative to outside housing 36 provides the telescoping nature of slider 126. FIG. 6 shows a cross-section of slider 126 but as a schematic view; as a schematic view, FIG. 6 omits various features of slider 126. FIG. 6 shows inside housing 38 surrounded by outside housing 36. FIGS. 3 and 4 show that jumper assembly 16 includes only one telescoping slider 126.

Telescoping slider 126 includes a plurality of conductors 42 housed therein which slide relative to one another so as to accommodate the telescoping nature of slider 126 when inside housing 38 moves between the retracted and open positions relative to outside housing 36. Conductors 42 are conductor bars 42 which include a first group 44 of conductor bars 42 attached to outside housing 36 and a second group 46 of conductor bars 42 attached to inside housing 38. The conductors of first group 44 can be referred to as conductors 44 or conductor bars 44. The conductors of second group 46 can be referred to as conductors 46 or conductor bars 46. FIG. 4 shows viewing-cutouts in outside and inside housings 36, 38 to show a portion of different conductor bars 42 (for illustrative purposes, no attachment features connecting conductor bars 42 to their respective housings 36, 38 are shown in FIG. 4). FIGS. 3 and 4 also show outside housing 36 including at least one end connector 48 (which is an electrical connector) configured for connecting (mechanically and electrically) to first electrical distribution device 14 or second electrical distribution device 14. Clips are shown attached to end connector 48, the clips being used to secure end connector 48 to an electrical connector of an electrical distribution harness 14.

Jumper assembly 16 also includes mesh sleeve 30 or flexible conduit 30, as well as end connector 50. For illustrative purposes, FIG. 3 is shown with mesh sleeve 30, while FIG. 4 is shown with flexible conduit 30. Either is thus usable in jumper assembly 16. Each is provided with the reference character 30. FIG. 4 shows conduit 4 having an elliptical cross-section; it is understood, however, that a circular cross-section, or any other suitably shaped cross-section, of conduit 30 may be used. Sleeve/conduit 30 is attached to inside housing 38 on one end and to end connector 50 on the other end. Sleeve/conduit 30 includes conductors 52 running therethrough; these conductors 52 can be formed as wires. End connector 50 is an electrical connector which is configured for mechanically and electrically connecting to first electrical distribution device 14 or said second electrical distribution device 14. By including conductors 42, 52 running through jumper assembly 16, jumper assembly 16 electrically interconnects first and second electrical distribution devices 14 and thus also electrifies first and second wall panels 12.

Figure 5:
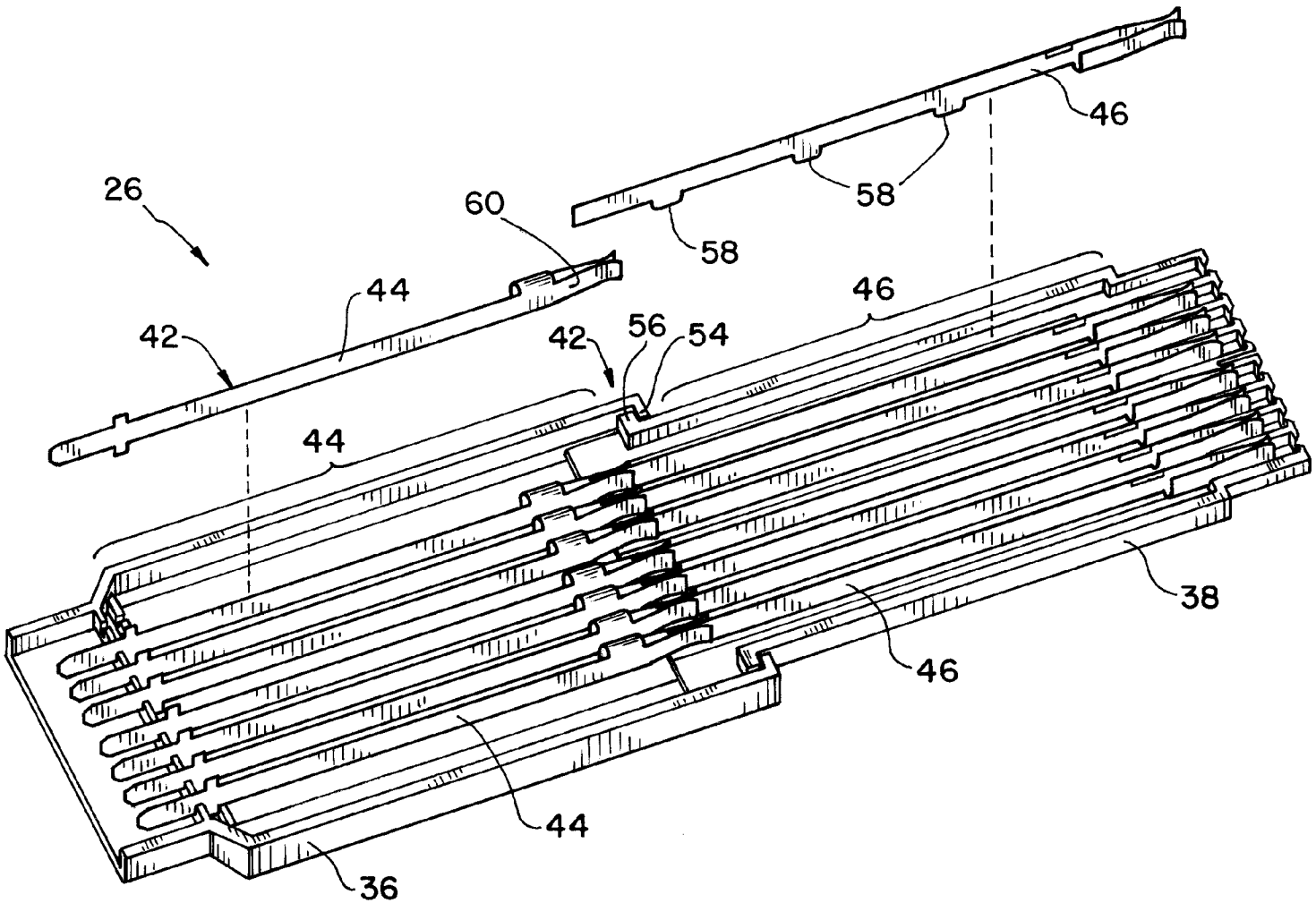
FIG. 5 is a perspective view of another embodiment of the slider according to the present invention.

FIG. 5 shows another embodiment of the telescoping slider according to the present invention. This embodiment of the slider is also shown in FIG. 2. More precisely, FIG. 5 shows one half of slider 26, with conductors 42 therein. It is understood that sliders 26 and 126 are substantially identical and thus the description of slider 26 serves as a description of slider 126, but for any differences ascertained when comparing FIGS. 3 and 4 with FIG. 5. For example, it is understood that the telescoping nature of outside and inside housings 36, 38, the use of lips 54, 56, as well as the ways of attaching conductor bars 42 to outside and inside housings 36, 38 and also to one another (that is, conductor bars 44 of outside housing 36 connected to conductor bars 46 of inside housing 38) as shown in FIG. 5 can be substantially identical to that of slider 126 of FIGS. 3 and 4. The description of the interior of slider 26 thus serves as a substitute for the description of slider 126.

As is apparent from FIG. 5, slider 26 is also retractable and extendable like slider 126. Slider 26 includes outside housing 36 and inside housing 38. Outside housing 36 can include L-shaped lips 54 as shown in FIG. 5, and inside housing 38 can include L-shaped lips 56 as shown in FIG. 5, lips 54 and 56 serving to abut against one another and thereby to prevent outside and inside housings 36, 38 from separating from one another in normal use as slider 26 is extended to its maximum extent. Conductor bars 42 include first group 44 of conductor bars and second group 46 of conductor bars. First and second groups 44, 46 form separate halves of conductor bars 42. First and second groups 44, 46 slide relative to one another to effectively lengthen and shorten conductor bars 42 as slider 26 is lengthened and shortened to thereby accommodate the telescoping nature of slider 26. For example, one conductor bar 42 includes a conductor of first group 44 and a conductor of second group 46 which are paired together and thus in essence form one extendable conductor bar 42 running from one longitudinal end of slider 26 to the other longitudinal end of slider 26. The conductor pair 42 shown exploded from slider 26 in FIG. 5 is discussed as being exemplary of the other conductor pairs 42 in slider 26. Further, at least one conductor of each conductor pair 42 has structure configured for preventing lateral deflection of the conductor pair 42. Such structure can be continuous or discontinuous. For example, FIG. 5 shows that conductor bar 46 includes a plurality of projecting tabs 58 spaced apart intermittently along one longitudinal edge of conductor bar 46. These tabs 58 fit in a single continuous slot or a plurality of corresponding discrete slots formed in inside housing 38. By fitting tabs 58 of conductor bar 46 into the corresponding slots in a plastic, for example, inside housing 38, conductor bar 46 is intermittently supported by inside housing 38 along the length of conductor bar 46 and unacceptable movement of conductor bar 46 (as well as conductor bar 44 of outside housing 36) is prevented when conductor bars 44, 46 slide relative to one another.

Further, conductor bar 44 of outside housing 36 can have a female end 60 for receiving a male end of conductor bar 46 of inside housing 38, as shown in FIG. 5. A line contact can be provided in the area where conductor bars 44, 46 contact one another to enhance the electrical connection between conductor bars 44, 46. Such a line contact can, for instance, provide a higher connection force and a consistent clamping force between conductor bars 44, 46. This line contact can be formed by a projection (not shown) on one or both prongs of the female end 60 of conductor bar 44. The projection can be formed by a linear rib having, for example, a generally hemispherical cross-section or a generally triangular cross-section; these shapes of the projection are by way of example and are not intended to be limiting. Alternatively, the projection can be formed by a plurality of discrete contact spheres (i.e., hemispheres) which can be provided on each female prong on the mating end of conductor bar 44 to enhance the contact between conductor bars 44, 46.

As mentioned above, slider 126 can be extended, as needed, by an installer of electrical distribution system 10; in other words, slider 126 can be selectively lengthened or shortened and thus occupy a fully retracted position, a fully extended position, or a plurality of intermediate positions therebetween. These intermediate positions may not be predetermined or, alternatively, may be predetermined so that slider 126 provides a tactile feel to an installer when an intermediate position, for example, is reached. In furtherance thereof, outside and inside housings 36, 28 (each of which can be made of plastic) can further include a ratchet function for extension resistance. In other words, slider housing 40 can include a plurality of structural features (not shown) configured for selectively locking outside and inside housings 36, 38 together in one of a plurality of predetermined locking positions so that slider 126 takes on one of a number of predetermined lengths. The structural features can be detents which stop or otherwise capture corresponding features of housing 40.

In use, electrical distribution devices 14 are connected to their respective wall panels 12 in the corresponding raceways 18 in the preferred locations within those raceways 18. A gap then exists between these two electrical distribution devices 14 and electrical connectivity will not be provided to the right-hand side electrical distribution device 14, assuming power flows from the left-hand side electrical distribution device 14. Thus, jumper assembly 16 is provided to bridge the gap between devices 14 and thus to transmit electricity from one device 14 to the other device 14. Either end connector 48, 50 can be connected to device 14. Assuming end connector 48 is used to connect to the left-hand side device 14 in FIG. 1, end connector 50 then connects to the right-hand side device 14 in FIG. 1. In so doing, outside and inside housings 36, 38 of slider 126 can be extended or retracted as necessary to provide the right amount of length for jumper assembly 16 between devices 14.

The present invention further provides a method of electrifying a plurality of wall panels 12. The method includes the steps of: providing electrical distribution system 10 including first electrical distribution device 14 connected to first wall panel 12 of the plurality of wall panels 12, second electrical distribution device 14 connected to second wall panel 12 of the plurality of wall panels 12, and jumper assembly 16, jumper assembly 16 including telescoping slider 126 which includes a plurality of conductors 40 housed therein which slide relative to one another; and connecting jumper assembly 16 to first electrical distribution device 14 and to second electrical distribution device 14. Slider 126 includes outside housing 36 and inside housing 38. The method further includes the step of moving outside housing 36 and inside housing 38 between a retracted position and an extended position relative to one another and thereby adjusting a length of jumper assembly 16 depending upon a distance between first and second electrical distribution devices 14. Jumper assembly 16 includes only one telescoping slider 126. Conductors 42 are conductor bars 42 which include a first group 44 of conductor bars 42 attached to outside housing 36 and a second group 46 of conductor bars 42 attached to inside housing 38. Jumper assembly 16 further includes end connector 32 and mesh sleeve 30 or conduit 30 attached to inside housing 38 and end connector 32, mesh sleeve 30 or conduit 30 including a plurality of conductors 52 running therethrough, end connector 32 connecting to first electrical distribution device 14 or second electrical distribution device 14. Outside housing 36 includes at least one end connector 50 connecting to first electrical distribution device 14 or second electrical distribution device 14.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical distribution system for electrifying a plurality of wall panels, said electrical distribution system comprising:

a jumper assembly including a telescoping slider which includes a plurality of conductors housed therein which slide relative to one another, said jumper assembly configured for connecting to a first electrical distribution device connected to a first wall panel of the plurality of wall panels and for connecting to a second electrical distribution device connected to a second wall panel of the plurality of wall panels.

2. The electrical distribution system of claim 1, wherein said slider includes an outside housing and an inside housing which are configured for moving between a retracted position and an extended position relative to one another and thereby for adjusting a length of said jumper assembly depending upon a distance between said first and second electrical distribution devices.

3. The electrical distribution system of claim 2, wherein said jumper assembly includes only one said telescoping slider.

4. The electrical distribution system of claim 2, wherein said plurality of conductors are conductor bars which include a first group of conductor bars attached to said outside housing and a second group of conductor bars attached to said inside housing.

5. The electrical distribution system of claim 2, wherein said jumper assembly further includes an end connector and one of a mesh sleeve and a conduit attached to said inside housing and said end connector, said one of said mesh sleeve and said conduit including a plurality of conductors running therethrough, said end connector configured for connecting to one of said first electrical distribution device and said second electrical distribution device.

6. The electrical distribution system of claim 2, wherein said outside housing includes at least one end connector configured for connecting to one of said first electrical distribution device and said second electrical distribution device.

7. A jumper assembly of an electrical distribution system for electrifying a plurality of wall panels, said jumper assembly comprising:

a telescoping slider which includes a plurality of conductors housed therein which slide relative to one another, the jumper assembly configured for connecting to a first electrical distribution device connected to a first wall panel of the plurality of wall panels and for connecting to a second electrical distribution device connected to a second wall panel of the plurality of wall panels.

8. The jumper assembly of claim 7, wherein said slider includes an outside housing and an inside housing which are configured for moving between a retracted position and an extended position relative to one another and thereby for adjusting a length of the jumper assembly depending upon a distance between said first and second electrical distribution devices.

9. The jumper assembly of claim 8, wherein the jumper assembly includes only one said telescoping slider.

10. The jumper assembly of claim 8, wherein said plurality of conductors are conductor bars which include a first group of conductor bars attached to said outside housing and a second group of conductor bars attached to said inside housing.

11. The jumper assembly of claim 8, further including an end connector and one of a mesh sleeve and a conduit attached to said inside housing and said end connector, said one of said mesh sleeve and said conduit including a plurality of conductors running therethrough, said end connector configured for connecting to one of said first electrical distribution device and said second electrical distribution device.

12. The jumper assembly of claim 8, wherein said outside housing includes at least one end connector configured for connecting to one of said first electrical distribution device and said second electrical distribution device.

13. A method of electrifying a plurality of wall panels, said method comprising the steps of:

providing an electrical distribution system including a first electrical distribution device connected to a first wall panel of the plurality of wall panels, a second electrical distribution device connected to a second wall panel of the plurality of wall panels, and a jumper assembly, said jumper assembly including a telescoping slider which includes a plurality of conductors housed therein which slide relative to one another; and connecting said jumper assembly to said first electrical distribution device and to said second electrical distribution device.

14. The electrical distribution system of claim 13, wherein said slider includes an outside housing and an inside housing, said method further including the step of moving said outside housing and said inside housing between a retracted position and an extended position relative to one another and thereby adjusting a length of said jumper assembly depending upon a distance between said first and second electrical distribution devices.

15. The electrical distribution system of claim 14, wherein said jumper assembly includes only one said telescoping slider.

16. The electrical distribution system of claim 14, wherein said plurality of conductors are conductor bars which include a first group of conductor bars attached to said outside housing and a second group of conductor bars attached to said inside housing.

17. The electrical distribution system of claim 14, wherein said jumper assembly further includes an end connector and one of a mesh sleeve and a conduit attached to said inside housing and said end connector, said one of said mesh sleeve and said conduit including a plurality of conductors running therethrough, said end connector connecting to one of said first electrical distribution device and said second electrical distribution device.

18. The electrical distribution system of claim 14, wherein said outside housing includes at least one end connector connecting to one of said first electrical distribution device and said second electrical distribution device.

* * * * *